United States Patent [19]

Carrigan

[11] 4,029,526

[45] June 14, 1977

[54] METHOD OF FLAME HARDENING GEARS

[75] Inventor: James David Carrigan, Odessa, Tex.

[73] Assignee: Vance Industries, Inc., Odessa, Tex.

[22] Filed: June 16, 1975

[21] Appl. No.: 586,911

Related U.S. Application Data

[62] Division of Ser. No. 406,141, Oct. 15, 1973, Pat. No. 3,891,194.

[52] U.S. Cl. ..... 148/147; 148/151; 148/152; 148/153

[51] Int. Cl.[2] ..... C21D 9/32

[58] Field of Search ..... 148/147, 151, 152, 153

[56] References Cited

UNITED STATES PATENTS

| | | | |
|---|---|---|---|
| 2,132,110 | 10/1938 | Holler | 148/151 |
| 2,199,313 | 4/1940 | Holler et al. | 148/151 |

*Primary Examiner*—R. Dean

*Attorney, Agent, or Firm*—Marcus L. Bates

[57] ABSTRACT

Flame hardening method and apparatus for tempering gear teeth and the like which comprises quench means for rapidly cooling selected ones of the gear teeth to a temperature which avoids the formation of decomposition products, and a heat source spaced from the quench means for raising the temperature of selected ones of the gear teeth to a value which promotes the formation of an austenitic structure.

Mount means rotatably support the gear with selected ones of the circumferentially extending teeth being placed in heat transfer relationship with the heat source and the quench.

Index means rotate the gear an amount which moves one gear tooth from the heat source to the quench means in a manner whereby all of the teeth of the gear must be treated one time before any tooth can be treated a second time.

9 Claims, 12 Drawing Figures

METHOD OF FLAME HARDENING GEARS

REFERENCE TO RELATED PATENT APPLICATIONS

Ser. No. 406,141 filed Oct. 15, 1973 10/15/73 for James David Carrigan entitled "Flame Hardener," U.S. Pat. No. 3,891,194, of which this instant application is a division.

BACKGROUND OF THE INVENTION

It is known to heat steel into the austenitic region followed by quenching sufficiently to avoid the formation of ferrite, pearlite, and bainite. Hypoeutectoid steels are quenched from a temperature in excess of 1600° F., whereas hypereutectoid steels are quenched from a temperature in excess of 1340° F. Various alloys inhibit the formation of decomposition products and allow considerably slower cooling rates and therefore is advantageous in hardening of thick pieces of steel.

Accordingly, it is well known in the art to heat-treat steels by heating the material to a temperature in excess of 1670° F. and thereafter rapidly cooling the metal so as to avoid the formation of decomposition products.

It is often desirable, especially on gears and sprockets, to harden or temper the outer marginal surface area of the teeth and to leave the main body or central portion in an annealed or normalized condition. The heat treated sprocket teeth will exhibit resistance to abrasive wear while the untreated main central body portion of the sprocket will exhibit a crystalline structure comprised of a relatively smaller grain size. Hence, the sprocket's main body portion will be free of stresses and less likely to develop cracks and other flaws during usage.

It is known to heat-treat the entire sprocket by impinging a flame on the surface of the teeth so as to form austenitic steel, and to rapidly quench the entire sprocket by submersion in a liquid, either water or oil. This prior art hardening process is objectionable because the central body portion of the sprocket acts as a heat sink, and accordingly, it too is heated sufficiently to lose its original ductility. Accordingly, it is desirable to be able to take advantage of the heat sink properties of a sprocket so that the central body portion thereof remains ductile while at the same time the sprocket teeth are hardened so that they lose their ductility and become tempered, thereby attaining the maximum advantages from the metallic properties of the sprocket.

SUMMARY OF THE INVENTION

This invention relates to both method and apparatus for tempering selected areas of metallic goods, such as gear teeth, without destroying the ductility of the main body portion of the gear.

A heat source spaced from a quench means simultaneously provide for changing the crystalline structure of one portion of the gear teeth while the remaining gear teeth are maintained at a temperature level which avoids any change in the crystalline structure thereof.

A gear is rotatably mounted in indexed relationship with respect to the heat source and quench means so that each treated gear tooth is immediately rotated from the heat source into the quench, whereby each individual gear tooth must be heat treated immediately followed by quenching before any one gear tooth can receive a second heat treatment.

This sequential and cyclic treatment of the individual selected areas of the gear enables an outer marginal surface area of each gear tooth to be heated to a temperature level which lies within the austenitic region, and then rapidly cooled to a temperature level which avoids the formation of ferrite, pearlite, and bainite; while at the same time the remaining gear teeth and central gear body are maintained at a temperature which prevents change in its most desirable crystalline structure.

Therefore, a primary object of the present invention is the provision of method and apparatus for tempering selected portions of metallic goods.

Another object of the invention is to provide means by which metallic goods can be tempered so that a selected outer peripheral marginal portion of the goods change in crystalline structure while the interior portion of the goods retain their original crystalline structure.

A further object of this invention is to provide a means for heat treating cylindrical metal goods by simultaneously subjecting spaced selected areas of the goods to the action of an elevated and a depressed temperature and cyclicly quenching the heated area while still another area is subjected to heat.

A still further object of this invention is to disclose and provide apparatus for simultaneously subjecting spaced portions of metallic goods to a heating and quenching action and cyclicly moving the heated area into the quenched area, with the spaced portions of the goods being selected in a manner which causes all of the selected areas of the goods to be treated a first time before they can be treated a second time.

Another and still further object of this invention is to provide apparatus for cyclicly heating, quenching, and rotating a gear, with spaced teeth of the gear being simultaneously subjected to a heating and cooling action, after which the gear is rotated in a manner whereby each tooth being heated is thereafter immediately quenched with all of the teeth undergoing treatment before any one gear tooth can be treated a second time.

An additional object of the present invention is to provide apparatus which automatically treats each tooth of a gear by changing a tooth to a first temperature and immediately thereafter subjects the tooth to a second temperature, with each tooth of the gear receiving a first treatment before it can be subjected to a second treatment.

These and various other objects and advantages of the invention will become readily apparent to those skilled in the art upon reading the following detailed description and claims and by referring to the accompanying drawings.

The above objects are attained in accordance with the present invention by the provision of a method of heat treating metallic goods for use with apparatus fabricated in a manner substantially as described in the above abstract and summary.

DETAILED DESCRIPTION OF THE PREFERRED EMBODIMENTS

Figure 1A:
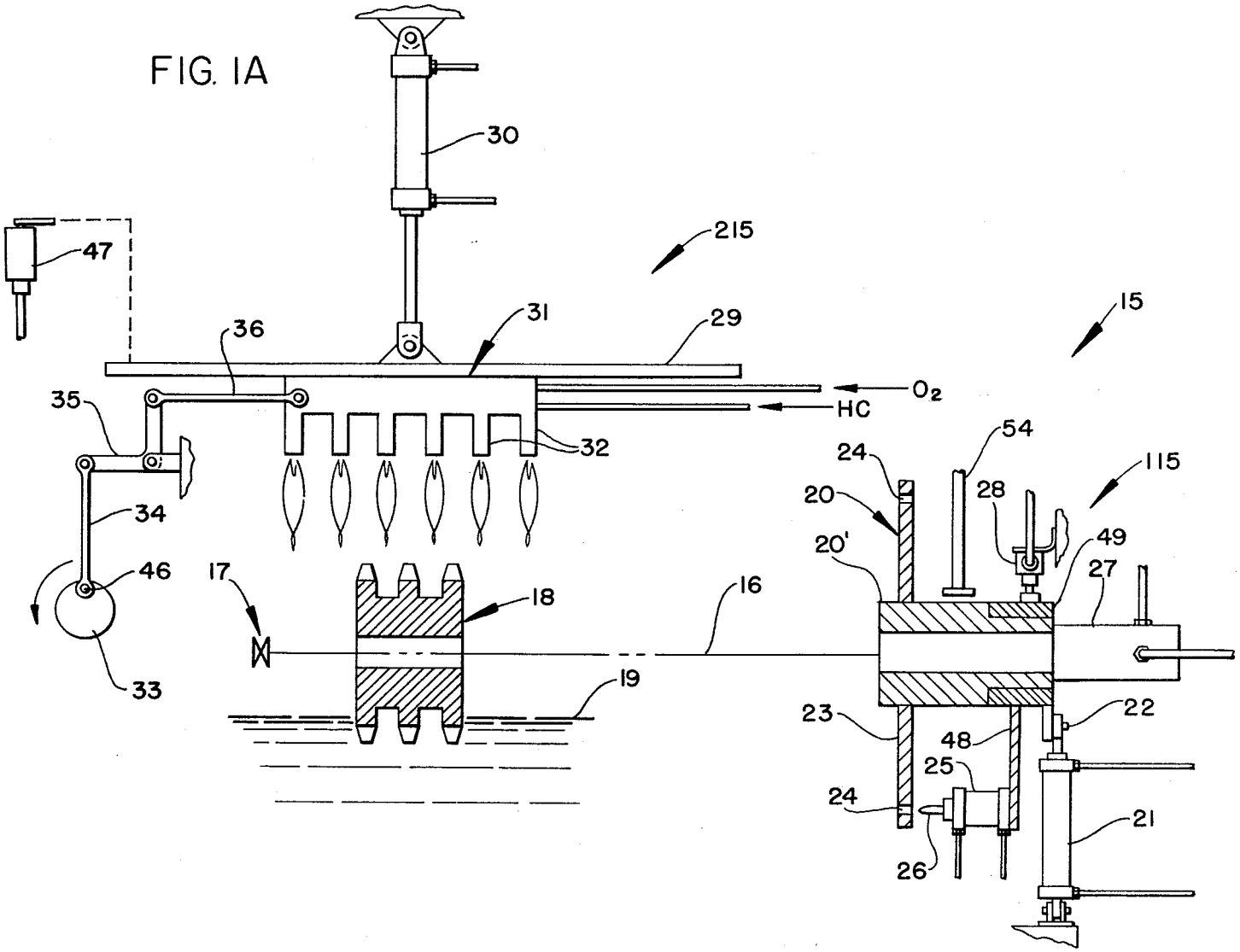
FIGS. 1A and 1B each set forth a part schematical, part diagrammatical, part cross-sectional representation of apparatus which sets forth the essence of the present invention.

FIG. 1A discloses apparatus 15 for carrying out the method of the present invention. The apparatus is comprised of mount means 115 for rotatably supporting a gear, and a heat source apparatus 215 for heating selected areas of a gear. The mount means includes a mandrel or the like disposed along the axial line 16 and includes releasable engaging means 17 so that a gear 18 can be rapidly mounted upon and removed from the mandrel in a commodious manner.

Quench means in the form of a fluid reservoir, having a fluid level 19, is disposed in underlying relationship respective to the gear undergoing treatment, with a lower marginal portion of the gear being immersed below the fluid level and in heat conducting relationship respective to the reservoir liquid.

The mount means includes means 20 by which the gear can be cyclicly rotated. Means 20 includes a main body portion 20′ rigidly affixed to the mandrel so that when the body is rotated, the mandrel and gear must move therewith.

An air actuated cylinder 21 has the piston thereof journaled at 22 so that a crescent plate member 48 can move independently of index plate member 23. The index plate is provided with a plurality of circumferentially disposed apertures 24 about an outer marginal edge thereof. The last named apertures each cooperate with a plunger device 25 by receiving pin 26 thereinto when the pin is extended therefrom and in axial alignment therewith, as will be explained in greater detail later on in this disclosure.

Air actuated gear release cylinder 27 has the piston thereof connected to a pilot rod means which extends through the central longitudinal axis of the hollow mandrel for actuating a releasable gear holder mechanism, the details of which will be better appreciated later on in this disclosure. Limit switch 28 is actuated in response to movement of the crescent plate member and provides part of the automatic control apparatus of the present invention.

The heat source is comprised of a movable mount plate 29 which is advanced towards and away from the gear by an air actuated retract cylinder 30. A torch holder 31 is mounted for movement to the mount plate and has a plurality of spaced torch nozzles 32 which provide an oxy-acetylene flame for direct impingement upon selected ones of the teeth of the gear, or more particularly a single horizontal row of teeth as seen in the present illustration.

Crank 33 is supported on a base of the machine and when rotated drives a link 34 which oscillates a bell crank 35, with the bell crank imparting limited reciprocatory motion into the torch holder by means of a connecting rod 36. Limit switch 47 is strategically placed to be actuated by the movable mount plate so as to enable control of the action of the piston associated with the retract cylinder.

Throughout the remaining figures of the drawings, wherever possible, like or similar elements will be referred to by like or similar numerals, and the foregoing numerals used in conjunction with FIG. 1A will be found applied to like or equivalent elements in the remaining figures.

Figure 1B:
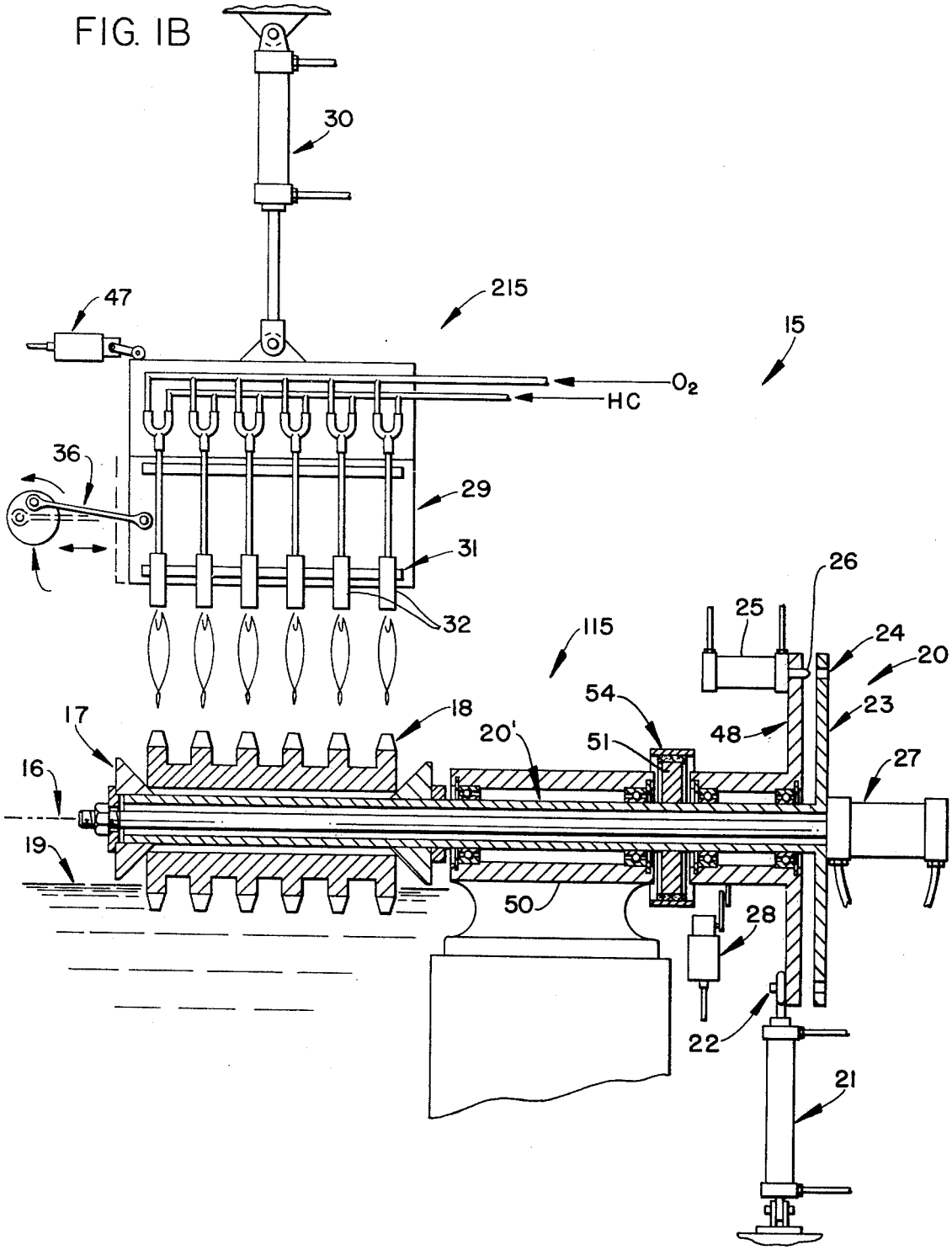

In the more specific embodiment of FIG. 1B the mount means 20 is seen to include a hollow mandrel 20′ which has a free marginal end portion to which there is removably attached the before mentioned releasable engaging means 17.

Air actuated air cylinder 21 has the piston thereof journaled at 22 to the crescent plate member 48. The crescent plate member is rotatably journaled in captured relationship to the exterior surface of the mandrel so that it can be independently turned about the central axis 16. Index plate member 23 is disposed adjacent to the crescent plate member with each plate member being arranged in spaced vertical parallel planes.

Brake drum 51 is affixed to the mandrel and can be selectively engaged by the cooperating brake band 54 so that the mandrel is rendered non-rotatable while the brake assembly is engaged therewith.

It should be noted that the heat source apparatus preferably is provided with one torch nozzle for each tooth of a row of teeth. The connecting rod 36 enables the crank to impart reciprocatory motion into the torch holder, while the retract cylinder 30 advances the torches into heat transfer relationship respective to the sprocket undergoing treatment.

Figure 2:
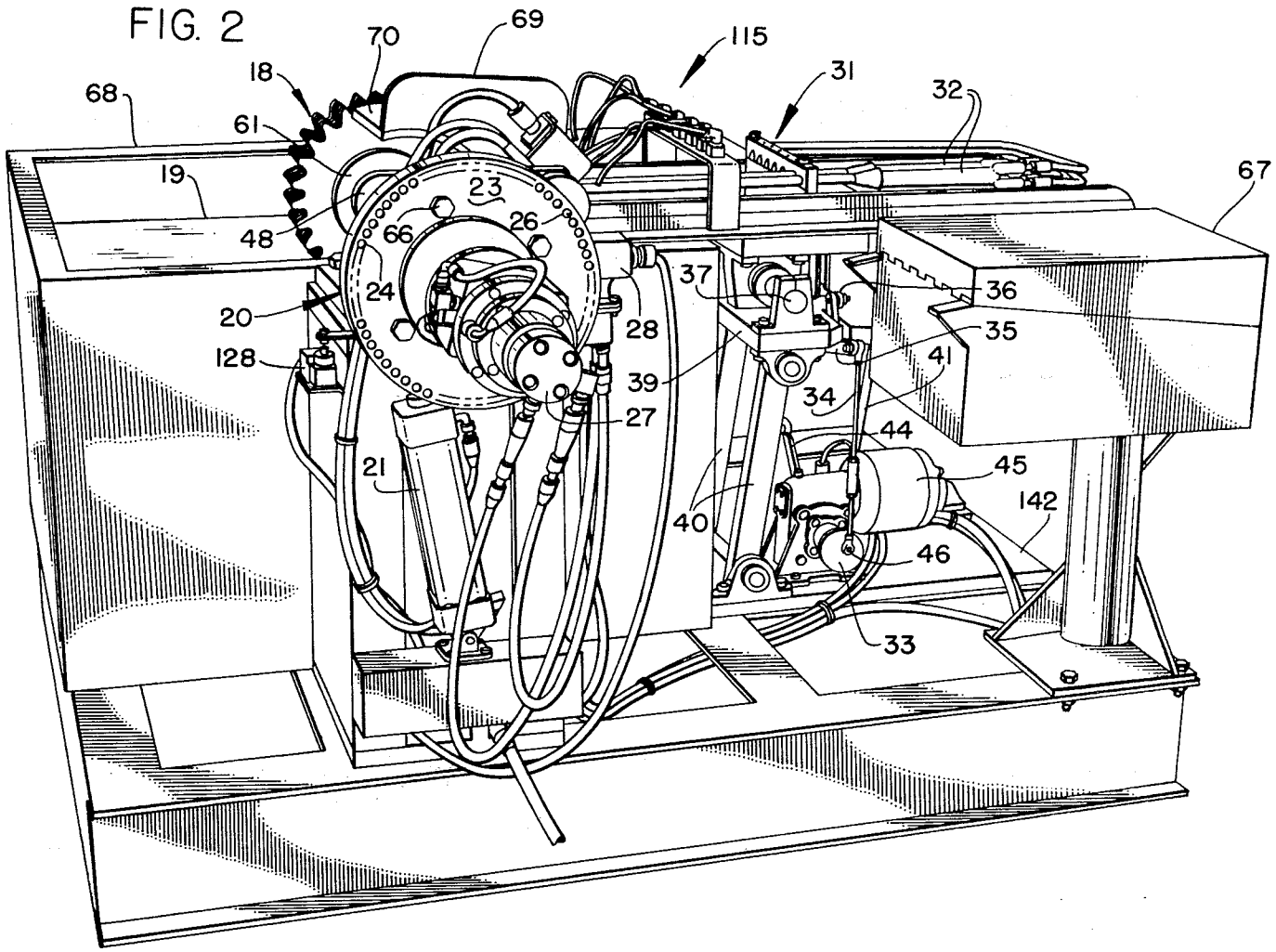
FIG. 2 is a perspective front view of one form of apparatus made in accordance with the diagrammatical teachings of FIG. 1.
Figure 3:
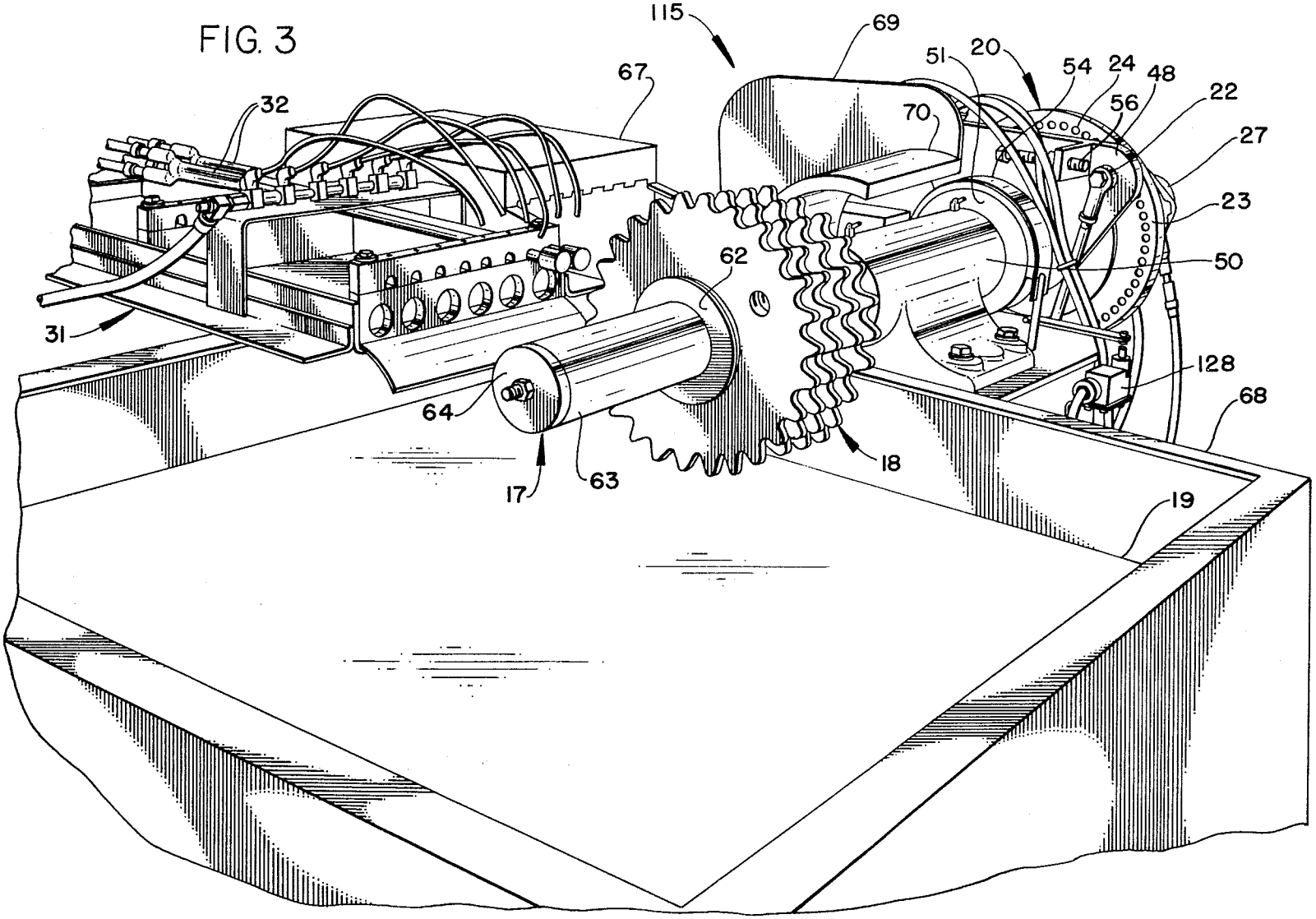
FIG. 3 is an enlarged, fragmentary, perspective view which discloses an upper rear portion of the apparatus disclosed in FIG. 2.
Figure 4:
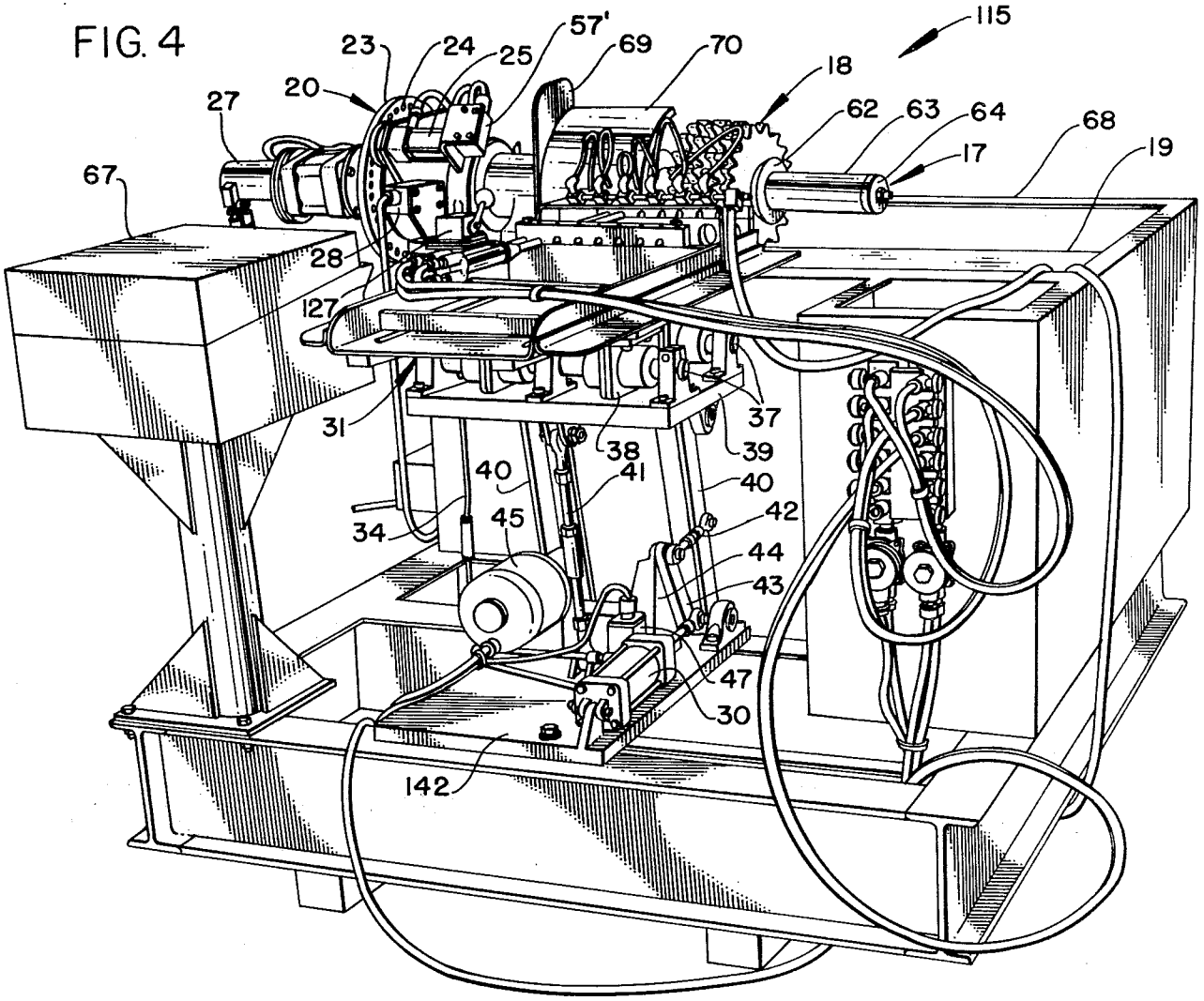
FIG. 4 is a perspective view which discloses the right side of the apparatus seen in FIG. 2.
Figure 5:
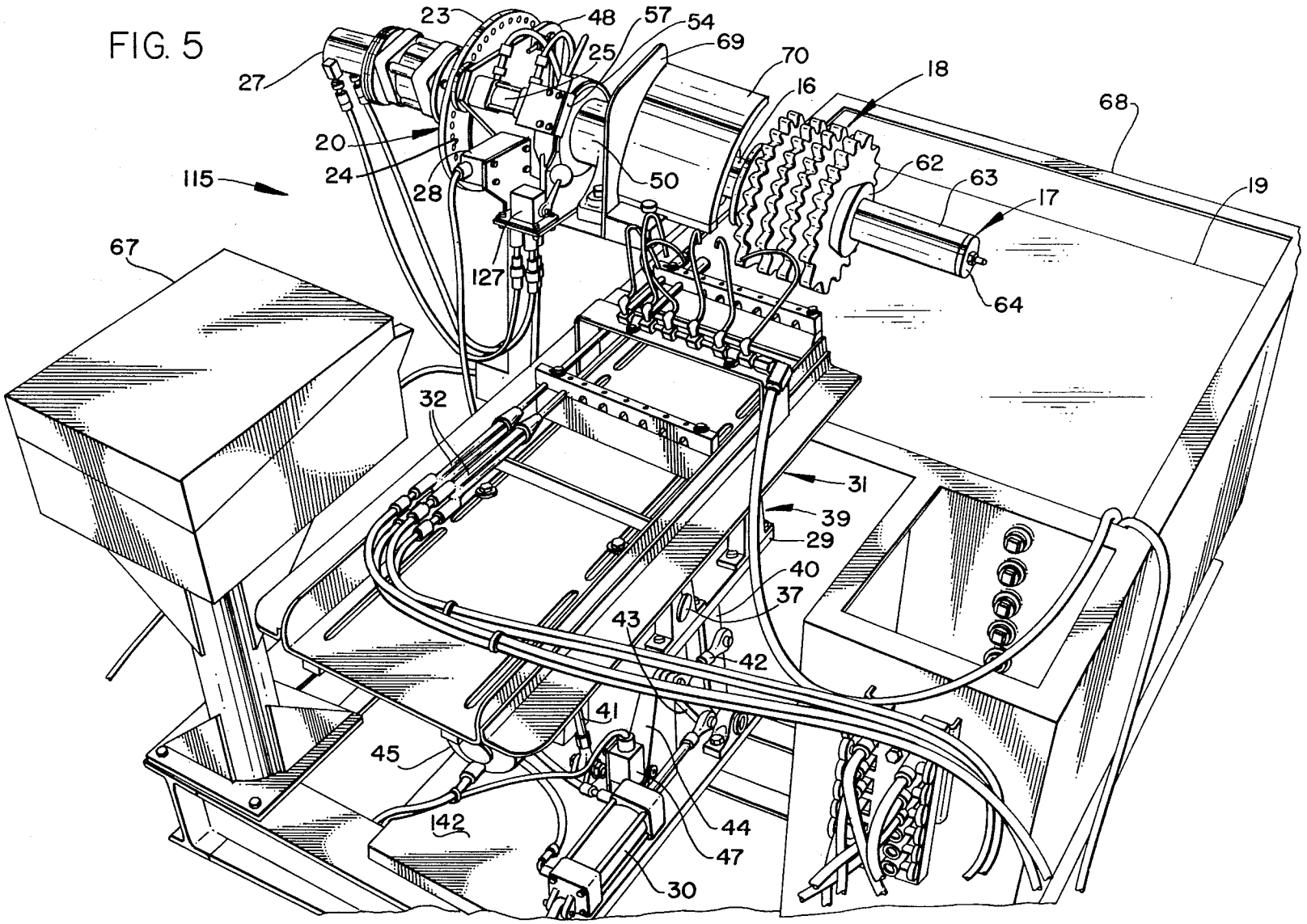
FIG. 5 is an enlarged, fragmentary, top perspective view of the apparatus disclosed in FIG. 4.
Figure 7:
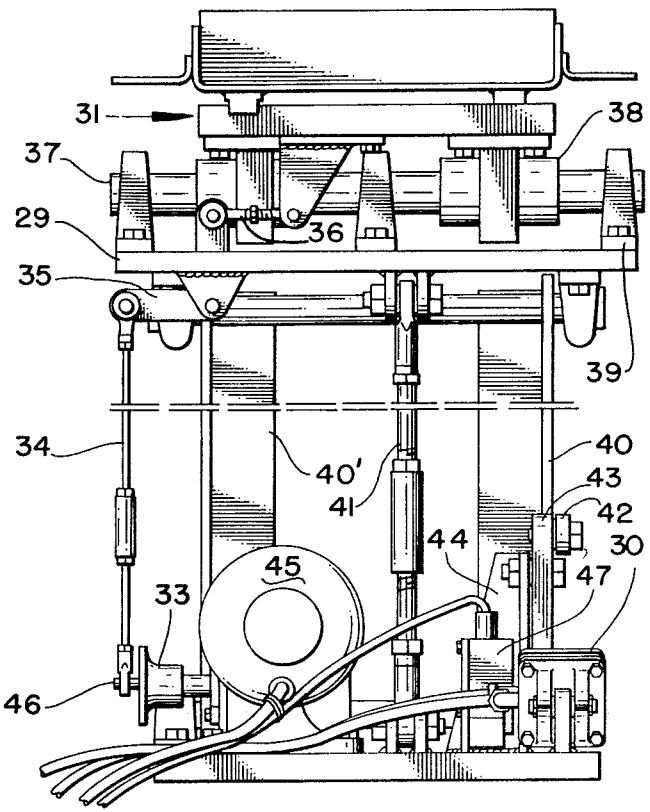
FIG. 7 is an end view of the apparatus disclosed in FIG. 6.
Figure 6:
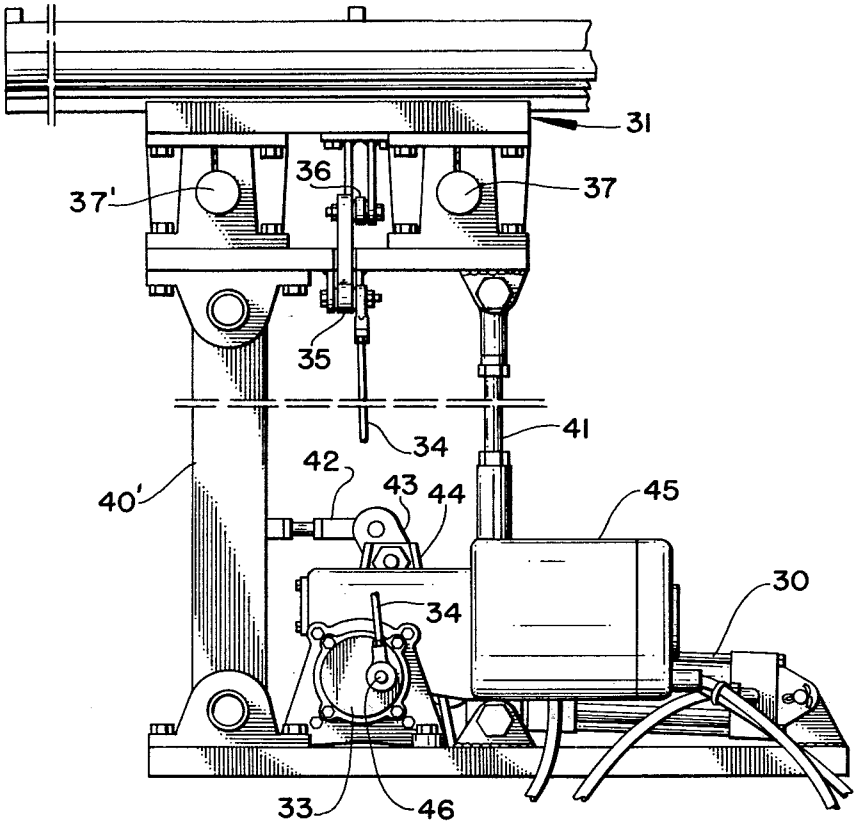
FIG. 6 is an enlarged, fragmentary, side elevational view of part of the apparatus disclosed in FIG. 2.

As seen in various ones of the remaining figures, and in particular FIG. 2 in conjunction with FIGS. 6 and 7, the before mentioned connecting rod 36 is seen to be connected to a downwardly depending ear which is rigidly affixed to the torch holder mount plate so that oscillatory motion can be imparted thereinto with the torch holder reciprocating in captured relationship along shaft 37 by means of low friction mount bushing 38. The spaced parallel shafts 37 and 37′ are held in proper alignment respective to one another by mount blocks 39. The blocks are rigidly affixed to plate member 29. Plate member 29 is journaled to a pair of forwardly spaced struts and a single rear strut, 40 and 41, respectively, with the struts more or less forming a parallelogram which is journaled at each corner thereof so as to maintain the torch support at a constant angle of attack as it is moved into close proximity of and away from the gear.

A link 42 ties the strut 40 to a lever 43, with the pivoted end of the lever being journaled to an anchored upstanding fixed mount 44. The piston of the retract cylinder actuates the lever which in turn imparts motion into the parallelogram for advancing and retracting the torch holder.

Figure 9:
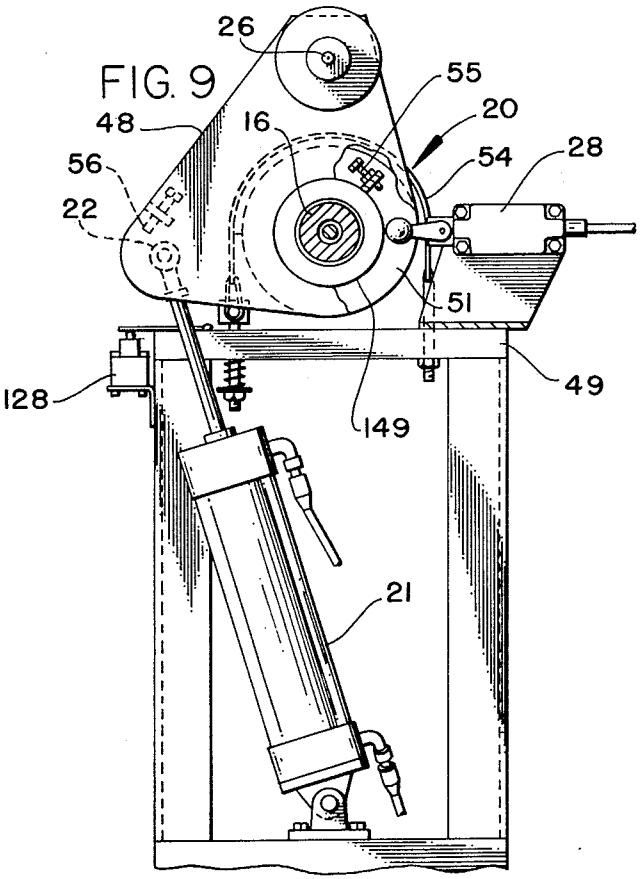
FIG. 9 is a fragmentary, part cross-sectional, enlarged illustration which sets forth some of the details of the apparatus disclosed in FIG. 8.
Figure 10:
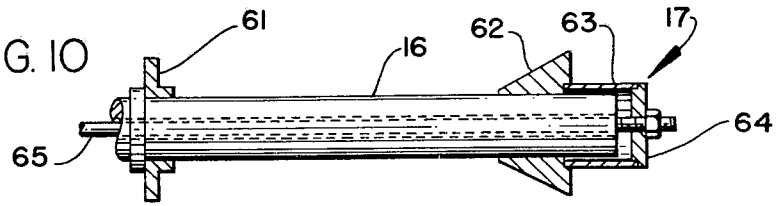
FIG. 10 is a fragmentary, enlarged, part cross-sectional illustration which discloses part of the apparatus seen in the foregoing figures; and, FIG. 11 is a schematical flow sheet which sets forth one control circuit which can be used in conjunction with the apparatus disclosed in the foregoing figures.
Figure 8:
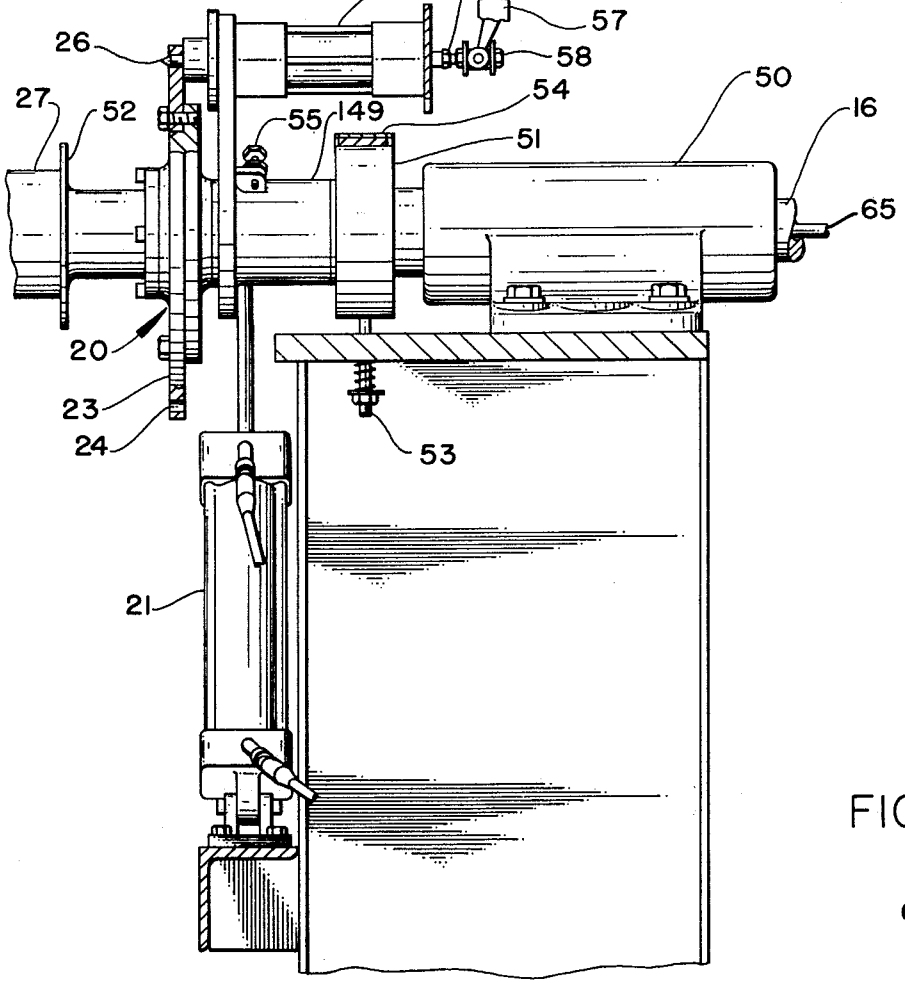
FIG. 8 is a detailed, part cross-sectional, enlarged detailed view of part of the apparatus disclosed in the foregoing figures.

As seen in FIGS. 8 and 9, in conjunction with other figures of the drawings, the crescent plate member 48 is rigidly affixed to a cylindrical housing 149 of limited length, with the housing being rotatably arranged with respect to the mandrel so that the housing can move along a limited arcuate path respective to the bearing support housing 50 and to the index plate. Brake drum 51 is attached to the mandrel and moves therewith. The air cylinder 27 is attached at 52 so that it can swivel with the index plate assembly. Brake adjustment 53 is received through the base plate 49 so that a brake band 54 can selectively prevent rotational motion of the mandrel while the crescent plate moves the plunger device relative to the index plate.

In FIGS. 8 and 9 it will be noted that spaced stop means 55 and 56 are attached to the crescent plate and are moved therewith. Limit switches 28 and 128 are engaged and actuated by the spaced stop means. Limit switch 57 is rearwardly mounted relative to the cylinder 25 so that the illustrated lever thereof is captured between the spaced flanges 58 and 59 of the plunger device thereby causing the switch to be actuated in response to movement of the plunger pin 26.

As seen in FIGS. 1B, 3, 5, and 10, the free end, or gear supporting end, of the mandrel has spaced flanges 61 and 62 removably affixed thereto with the cone shaped flanges having a removable adjustable cylindrical member 63 bearing thereagainst. Manual control valve assembly 127 actuates the air cylinder 27 causing the piston thereof to move the pilot rod 65 to thereby move the spaced flanges toward or away from one another so as to clamp the gear in axial aligned relationship along the longitudinal axis 16.

Figure 11:
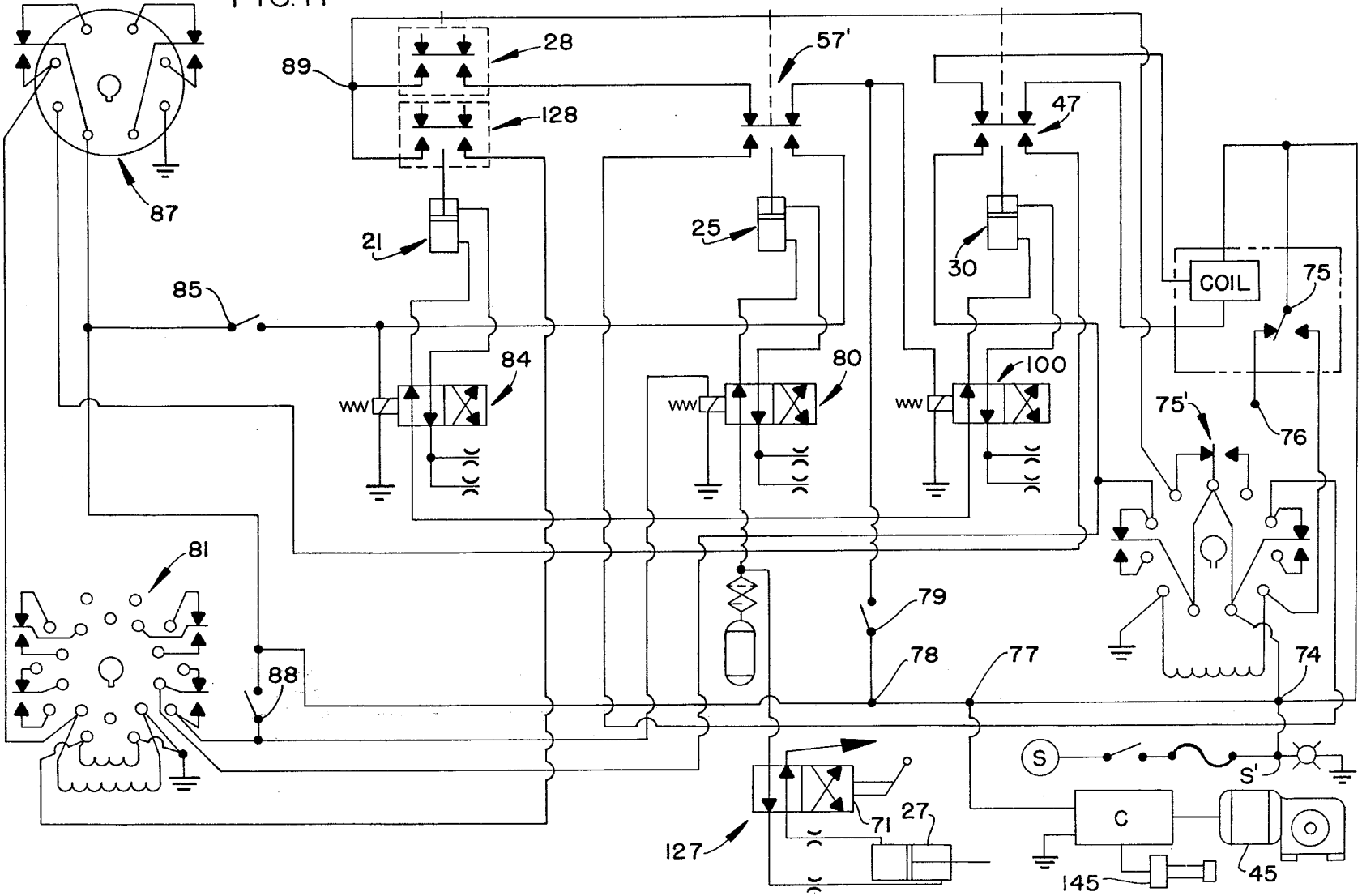

Control box 67 protectingly contains part of the circuitry illustrated in FIG. 11 so that the operator of the Flame Hardening Machine can control the entire action of the apparatus from close proximity of the control box. The outer peripheral edge 68 of the quench tank preferably is a self-supporting monocoque structure built up in a conventional manner. A heat shield 69 has an arcuate portion 70 for protecting the main bearing support housing from the deleterious effects of the heat source.

Broadly, the operation of the flame hardening apparatus comprises placing a cylindrical metallic object, illustrated herein as a multi-toothed sprocket, and hereafter called a gear, onto a mandrel so that the lowermost marginal edge portion of the gear is submersed below the water level, and another marginal edge portion of the gear is placed sufficiently close to the torch nozzles so that combustion of hydrocarbons creates a flame which impinges upon a row of gear teeth.

After the row of teeth have been subjected to the action of the flame for a sufficient amount of time to cause the metal thereof to be heated into the austenitic region, the actuating cylinder 30 retracts the movable mount plate into its alternate position. The plunger device 25 then retracts plunger pin 26 from its associate aperture, and air cylinder 21 moves the crescent plate 48 a limited arcuate amount relative to the mandrel. Next the plunger device 25 engages the plunger pen 26 with an aperture 24 with the last aperture being spaced about 90° from the former aperture. The cylinder 21 returns the arcuate plate to its original position, bringing the index plate therewith, and actuating cylinder 30 returns the movable mount plate bearing the torches into heat transfer relationship respective to the row of gear teeth.

This action rotates the heated row of gear teeth into a position underlying the liquid level of the quench means, and brings a new row of untreated gear teeth into alignment with the flame from the torches. The time lapse in cycling from a heating to a quenched condition must occur rapidly enough to avoid the formation of pearlite and other decomposition products which tend to increase the ductility of the steel.

Since the lowermost marginal edge portion of the gear is always submerged within the quench means, and since the flame from the torches is played onto a selected limited area represented by a width slightly greater than a single horizontal row of teeth, it will now be appreciated that the massive body of the gear advantageously provides a heat sink which maintains the entire gear, except for the high temperature region, at a temperature below the austenite and sementite formation range so that only the outermost marginal surface area of the one row of teeth are subjected to a temperature of approximately 1670° F. As to the rapid transition between 1333° and ambient temperature which must occur somewhere between the heat source and the quench, it is believed that the rapid temperature gradient actually promotes the quality of the gear in that a limited amount of annealing and stress relieving treatment is imparted into the gear at critical areas. Stated differently, the gear teeth become austenitic with there being a rapid transition between the surface of the teeth and the gear body, which retains its original crystalline structure.

Each cycle of the apparatus displaces the gear approximately 90° so that a new row of teeth are brought into the heating region, while the heated teeth are placed within the quench tank. For example, in heating a gear having 32 rows of teeth thereon, it is preferred that the gear be rotated either seven or nine teeth which is exactly 90° plus or minus one tooth.

For example, numbering the teeth 1–32, the sequential order of treatment is as follows: 1, 8, 15, 22, 29, 4, 11, 18, 25, 32, 7, 14, 21, 28, 3, 10, 17, 24, 31, 6, 13, 20, 27, 2, 9, 16, 23, 30, 5, 12, 19, and 26. Hence the index plate is arranged relative to the stops 55, 56 to cause each of the teeth to receive a first treatment before any one tooth can receive a second treatment.

By carrying out several different possible sequential orders in which the teeth are treated, each tooth of the gear will receive one treatment before it could inadvertently receive a second treatment. With this in mind, any number of different programs could be set up, as for example, quenching and heating at angular dispositions other than the before recited 90° plus or minus one row of teeth, depending upon the configuration of the object being treated.

Where a plurality of adjacent rows of teeth must be simultaneously heated and quenched, the before sequential order of cyclic operation can still be observed by considering dual or triple rows of adjacent teeth in the same manner that a single row of teeth was considered in conjunction with the before mentioned 32 toothed sprocket. Moreover, with this orderly sequential cyclic operation in mind, it is possible to consider a cylinder as being divided into a plurality of spaced adjacent peripheral areas with each of the co-extending areas being frictionally related to the gear tooth example above so as to provide for a pattern for sequentially heating and quenching the outer marginal exterior surface area thereof, so that all of the outer peripheral areas receive one treatment before any one area can receive a second treatment.

Looking now more specifically to the details of the operation of the present apparatus, those skilled in the art should now appreciate that a gear 18 can be placed on the mandrel by removing the fastener means, selecting a spacer 63 of the proper length, telescopingly sliding the gear against flange 61, after which the cone 62 is placed into engagement with the gear, whereupon shaft 65 can then be retracted by actuating air cylinder 27 with air control valve 127. This expedient rigidly mounts the gear so that it is properly located relative to the quench and to the heat source. Controller 67 is adjusted so that the duration of each cycle of treatment will attain a proper heat soak and additionally so that the apparatus will automatically be deenergized after the last row of teeth has been heat treated. The index plate 23 is selected to have the proper number of apertures therein, and stop means 55, 56 adjusted as may be required for proper operation of limit switch 28 in conjunction with the apertures of the index plate.

Automatic igniters can be provided for initiating a flame at the torches, so that when the apparatus is energized, cylinder 21 will be in the proper relative position and the actuating cylinder will move the mount plate forward to thereby move the torches so that the flame therefrom is properly positioned relative to a selected horizontal row of gear teeth, while motor 45 causes the torches to reciprocate relative to the mount plate. After a predetermined lapsed time, based upon experience for a particular size and composition of a gear, the controller apparatus causes the actuating cylinder to retract, pin 26 is retracted from the index plate, cylinder 21 rotates member 49 relative to the mandrel, pin 26 is returned into a different aperture 24, cylinder 21 returns member 49 to its original position, and since crescent plate 48 is tied to index plate 23 by means of the plunger pin, the mandrel must rotate between the limits provided by stop means 55, 56. This action causes the gear to rotate approximately 90°, depending upon the number of rows of teeth contained in the gear. Cylinder 30 returns the mount plate so that the flame from the torches is now in heat transfer relationship relative to a new row of teeth. The next cycle of operation has commenced and after another lapsed time, the apparatus will again cycle until the last remaining row of teeth have been heat treated and the controller "turns off" the apparatus. At this time air control valve 127 is actuated thereby moving pilot shaft 65 so as to enable flange 64 and cylinder 63 along with cone 62 to be removed from the mandrel and another untreated gear placed upon the mandrel in the before described manner.

One means by which the present apparatus can be automatically controlled is set forth in FIG. 11 wherein those skilled in the art of reading pneumatic-hydraulic and electrical circuitry will recognize that a source of current must be provided at S so that current flows to S′ and to the junctions 74, 75, 77, and 78. At this time the variable speed motor 45 and timing relay 87 are energized and the torches are moved into heat transfer relationship respective of the gear undergoing treatment.

After the first row of teeth has been heated the desired set time, timing relay 87 actuates the latching relay 81 to move air control valve 100 to a position which causes cylinder 30 to retract, thereby moving the torches away from the gear. As the cylinder 30 retracts it engages and moves switch 47 which energizes the cycle counter to indicate that the first row of gear teeth has completed its treatment.

The latching relay also moves the air control valve 80 to a position which causes the latching cylinder 25 to retract pin 26. As pin 26 is retracted, it engages and moves switch 57′, which energizes air control valve 84, causing cylinder 21 to rotate the head until the stop 55 engages the switch 128, thereby causing the latching relay 81 to return to its first or run position.

The return of the latching relay to its run position moves the air control valve 80 to a position which causes the cylinder 25 to extend pin 26 into an appropriate aperture of the index plate. As the pin is extended, switch 57′ is returned to its run position which actuates air control valve 84 causing cylinder 21 to rotate the arcuate plate member of the control head back to the run or heat treating position, rotating the mandrel therewith.

As the arcuate plate member is returned, stop 156 thereof engages switch 128 which shifts the air control valve 100 causing cylinder 30 to extend the torches into heat transfer relationship respective to the gear undergoing treatment.

The timing relay commences to time out, as the next cycle of operation begins. The automatic control circuitry continues the above cyclic operation until the last row of teeth is treated, whereupon the apparatus is "shut down" so that the treated gear can be replaced with a gear which is to be heat treated in the same above described manner.

I claim:

1. Method of flame hardening the teeth of a gear having radially spaced rows of teeth thereon comprising the steps of:

1. rotatably supporting a gear such that the gear is held stationary for a first time interval and thereafter rapidly rotated about the central axis thereof and again held stationary for a second time interval;
2. positioning a burner means such that combustion products form a flame which is emitted therefrom to provide a flame which directly impinges upon a single row of teeth;
3. positioning a quench means in spaced relationship to said burner means to enable one row of gear teeth to be quenched;
4. positioning the gear respective to the burner means and the quench means such that spaced rows of teeth thereof are simultaneously treated, with one row of teeth being subjected to a heating action and another row of teeth to a quenching action, with there being other rows of teeth circumferentially disposed in each direction about the gear and between the rows of teeth being heated and quenched;
5. supplying sufficient heat at the burner means to cause the metal of a row of teeth located at the burner means to attain a temperature which forms an austenitic structure;
6. supplying sufficient cooling at the quench means to cause the metal of a row of teeth located at the quench means to be cooled at a rate which avoids the formation of decomposition products;

7. rotating the gear about its central axis an amount which causes the row of gear teeth located at the burner means to be directly transferred to the quench means;

8. cyclicly carrying out the previous step a sufficient number of times to cause the gear to rotate a plurality of revolutions while all of the individual rows of gear teeth are subjected to the heating action of the burner means and the cooling action of the quench means a single time before any one row of teeth can be subjected to the action of the burner means a second time.

2. Method of treating a metal gear having radially spaced rows of teeth by individually flame hardening the rows of teeth positioned radially about the outer peripheral surface thereof comprising the steps of:

1. mounting the gear for axial rotation such that it is held stationary a first time interval and thereafter is axially rotated and again held stationary another time interval;
2. circumferentially positioning a flame producing torch means and a quench means in spaced relationship to one another and about the gear so that a finite number of rows of teeth are located between the rows of teeth thereof which are simultaneously being treated by the torch means and the quench means;
3. simultaneously placing one row of teeth of the gear in heat transfer relationship with respect to the flame of said torch means and another row of teeth of the gear in heat transfer relationship with said quench means, so that one row of teeth at the torch means attains an austenitic structure;
4. cyclically rotating the gear an amount which directly transfers the row of teeth thereof being heated to the location where the row of teeth thereof was being quenched;
5. controlling the amount of rotation in step (4) so that all spaced rows of teeth are treated a first time before any one row of teeth can be treated a second time, while said gear is rotated a plurality of revolutions.

3. The method of claim 1 wherein said quench means is supplied by supporting the gear in a manner to dispose a row of teeth thereof submerged within a liquid bath.

4. The method of claim 1 and further including the step of moving the burner means along a path parallel to the longitudinal central axis of the gear so that a row of teeth thereof which is undergoing treatment is subjected to a flame which oscillates respective to the row of gear teeth.

5. The method of claim 1 wherein said quench means is supplied by supporting the gear with a row of teeth thereof being submerged below the liquid surface of a liquid bath;

and further including the step of positioning the row of gear teeth to be heated so that the flame from said burner means is directed onto the outer surface area of the row of teeth;

and further including the step of continually moving the flame along a path which is parallel to the longitudinal central axis of the gear so that a row of teeth thereof which is undergoing treatment is subjected to a flame which oscillates respective to the row of gear teeth.

6. Method of claim 2 wherein the gear is mounted over a liquid bath with the lowermost marginal portion of the gear being immersed below the liquid level of the bath; and, impinging the flame from the burner means on the gear at a location circumferentially spaced from and above the liquid level such that a plurality of rows of gear teeth are located therebetween.

7. The method of claim 2 and further including the step of moving the torch means such that the flame therefrom moves laterally of the gear and parallel to the quench means so as to attain a more uniform surface temperature of the row of teeth being heated.

8. The method of claim 7 wherein said quench means is supplied by supporting the gear so that a row of teeth thereof is submerged within a liquid bath.

9. The method of claim 2 and further including the step of moving the torch along a path parallel to the longitudinal central axis of the gear so that the surface area of a row of teeth thereof which is undergoing treatment is subjected to a flame which oscillates respective to the gear.

* * * * *